US008997851B2

(12) United States Patent
Edvardsen et al.

(10) Patent No.: US 8,997,851 B2
(45) Date of Patent: Apr. 7, 2015

(54) GRINDING ARRANGEMENT FOR TOOL JOINTS ON A DRILL STRING

(75) Inventors: Per Espen Edvardsen, Fyllingsdalen (NO); Tom Kjetil Askeland, Straume (NO)

(73) Assignee: Siem Wis AS, Knarrevik (NO)

( * ) Notice: Subject to any disclaimer, the term of this patent is extended or adjusted under 35 U.S.C. 154(b) by 221 days.

(21) Appl. No.: 13/704,268

(22) PCT Filed: Jun. 8, 2011

(86) PCT No.: PCT/NO2011/000166

§ 371 (c)(1), (2), (4) Date: Mar. 22, 2013

(87) PCT Pub. No.: WO2011/159165

PCT Pub. Date: Dec. 22, 2011

(65) Prior Publication Data

US 2013/0213634 A1 Aug. 22, 2013

(30) Foreign Application Priority Data

Jun. 16, 2010 (NO) ..... 20100858

(51) Int. Cl.
*B24B 27/00* (2006.01)
*B08B 1/02* (2006.01)
(Continued)

(52) U.S. Cl.
CPC ..... *B24B 27/0053* (2013.01); *B08B 1/02* (2013.01); *B08B 9/023* (2013.01); *B24B 9/00* (2013.01); *E21B 17/006* (2013.01); *E21B 41/00* (2013.01)

(58) Field of Classification Search
CPC ..... E21B 27/0053; E21B 41/00; E21B 19/99; E21B 33/02; E21B 7/12; E21B 33/08; E21B 33/035; E21B 21/00; E21B 17/006; B08B 1/02; B08B 9/023; B24B 9/00; B24B 27/0053
USPC ..... 166/55.6, 55.7, 55.8, 84.1, 387, 84.4, 166/84.2; 15/88; 144/208.8; 451/271
See application file for complete search history.

(56) References Cited

U.S. PATENT DOCUMENTS 1,875,632 A 9/1932 McEvoy
2,064,577 A * 12/1936 Thayer ..... 15/88
(Continued)

FOREIGN PATENT DOCUMENTS

DE 2643769 A1 3/1978
DE 3339316 A1 5/1985
(Continued)

OTHER PUBLICATIONS

Patent Cooperation Treaty, International Search Report and Written Opinion, International Application No. PCT/NO2008/00125, mailed Aug. 22, 2008.
(Continued)

*Primary Examiner* — Yong-Suk (Philip) Ro
(74) *Attorney, Agent, or Firm* — Kilpatrick Townsend Stockton LLP

(57) ABSTRACT

A grinding arrangement is described to remove sharp edges on a pipe coupling (51) of a drill string (50), as a consequence of marks from the jaws of pliers and machines used to connect the pipe couplings (51) on a drill deck. A receiving unit (30) is arranged to receive a grinding unit (36) which is equipped with at least one grinding element (38), as the grinding unit (36) is arranged to be driven into the receiving unit (30) with the help of the drill string (50) or a suitable running tool and to be locked securely into the receiving unit (30). Furthermore, the receiving unit is arranged in a riser, landing string or in other connections between the drill deck and a wellhead and over a sealing arrangement for dynamic sealing around the drill string (50) during pressure controlled drilling.

14 Claims, 2 Drawing Sheets

(51) Int. Cl.

| | |
|---|---|
| ***B08B 9/023*** | (2006.01) |
| ***B24B 9/00*** | (2006.01) |
| ***E21B 17/00*** | (2006.01) |
| ***E21B 41/00*** | (2006.01) |

(56) References Cited

U.S. PATENT DOCUMENTS

| | | | | |
|---|---|---|---|---|
| 2,222,082 | A | 11/1940 | Leman | |
| 2,682,068 | A | 6/1954 | Harrigan | |
| 3,215,203 | A | 11/1965 | Sizer | |
| 3,387,851 | A | 6/1968 | Cigini | |
| 3,474,858 | A | 10/1969 | Gibson et al. | |
| 3,965,987 | A | 6/1976 | Biffle | |
| 4,149,603 | A | 4/1979 | Arnold | |
| 4,162,704 | A | 7/1979 | Gunther | |
| 4,315,553 | A | 2/1982 | Stallings | |
| 5,474,097 | A | 12/1995 | Lowe et al. | |
| 6,119,772 | A | 9/2000 | Pruet | |
| 6,325,159 | B1 | 12/2001 | Peterman et al. | |
| 6,412,554 | B1 | 7/2002 | Allen et al. | |
| 6,581,692 | B1 | 6/2003 | Koch et al. | |
| 6,688,394 | B1 | 2/2004 | Ayling | |
| 6,739,397 | B2 | 5/2004 | Ayling | |
| 7,188,683 | B2 | 3/2007 | Ayling | |
| 7,258,171 | B2 | 8/2007 | Bourgoyne et al. | |
| 7,438,135 | B2 | 10/2008 | Page et al. | |
| 7,779,903 | B2 | 8/2010 | Bailey et al. | |
| 2003/0221519 | A1 | 12/2003 | Haugen | |
| 2005/0061499 | A1 | 3/2005 | Hopper | |
| 2006/0037782 | A1 | 2/2006 | Martin-Marshall | |
| 2006/0065402 | A9 | 3/2006 | Fontana et al. | |
| 2009/0166046 | A1 * | 7/2009 | Edvardson et al. | 166/387 |
| 2010/0147525 | A1 | 6/2010 | Lerner et al. | |
| 2010/0175882 | A1 | 7/2010 | Bailey et al. | |
| 2010/0218937 | A1 | 9/2010 | Edvardsen et al. | |
| 2012/0292054 | A1 | 11/2012 | Orbell et al. | |

FOREIGN PATENT DOCUMENTS

| | | | |
|---|---|---|---|
| EP | 1 462 687 | A1 | 9/2004 |
| EP | 1 519 003 | A1 | 3/2005 |
| NO | 317 227 | | 9/2004 |
| WO | WO 99/49173 | | 9/1999 |
| WO | WO 2006/010906 | A1 | 2/2006 |
| WO | WO 2007/008085 | A1 | 1/2007 |

OTHER PUBLICATIONS

Patent Cooperation Treaty, International Preliminary Report on Patentability, International Application No. PCT/NO2008/00125, date completed Aug. 19, 2009.

Patent Cooperation Treaty, Written Opinion of the International Preliminary Examining Authority, International Application No. PCT/US2008/000125, mailed Jun. 10, 2009.

Patent Cooperation Treaty, International Search Report, International Application No. PCT/NO2006/00272, mailed Oct. 31, 2006.

Patent Cooperation Treaty, Written Opinion, International Applcation No. PCT/NO2006/00272, mailed Oct. 31, 2006.

Patent Cooperation Treaty, International Search Report, International Application No. PCT/NO2008/000274, mailed Nov. 4, 2008.

Patent Cooperation Treaty, Written Opinion, International Application No. PCT/NO2008/000274 mailed Nov. 4, 2008.

Patent Cooperation Treaty, International Preliminary Report on Patentability, International Application No. PCT/US2008/000274, dated Aug. 21, 2009.

Patent Cooperation Treaty, International Search Report, International Application No. PCT/NO2008/000228, mailed Aug. 10, 2008.

Patent Cooperation Treaty, Written Opinion, International Application No. PCT/NO2008/000228, mailed Aug. 10, 2008.

Patent Cooperation Treaty, International Preliminary Report on Patentability, International Application No. PCT/NO2008/000228, dated Aug. 9, 2009.

Patent Cooperation Treaty, International Search Report, International Application No. PCT/NO2011/000166, dated Sep. 20, 2011.

* cited by examiner

GRINDING ARRANGEMENT FOR TOOL JOINTS ON A DRILL STRING

The present invention relates to a grinding arrangement to remove sharp edges on a pipe coupling of a drill string resulting as a consequence of marks from the jaws of pliers and machines used to connect the pipe couplings on a drill deck.

In more detail, the invention relates to a grinding tool to grind a drill string in wells carrying air, water, drilling fluid or hydrocarbons, comprising at least one grinding unit that is arranged to partially or completely surround the drill string.

The invention can be used to grind away sharp edges and marks on a drill string that moves into or out of oil wells and gas wells in all water carrying, drilling fluid carrying or hydrocarbon carrying types of wells, both wells that have a valve tree (the well safety valves) placed on the ocean bottom, a platform, a vessel, on an appliance or on land. Meant by the expression drill string is any kind of connection of drill pipes with screw connections that are used between a drilling rig or drilling vessel and a well.

The invention relates to grinding arrangements for sealing arrangements and methods that make intervention and drilling possible in the above mentioned water carrying, drilling fluid carrying or hydrocarbon carrying wells by using a landing string, riser connection or other connections between the well and the drilling deck on a surface vessel, platform or other installations. The invention can also be used over, between or below well control equipment elements, whether the valve tree of the well is placed on the ocean bed or at the surface. The sealing arrangement and the method cover normal operation in the above mentioned water carrying, drilling fluid carrying or hydrocarbon carrying wells performed with the help of a drill string and snubbing string, and also said methods based on the use of new composites and thermoplastic materials as well as complementary solutions.

The drill string and snubbing string are hereafter described by the designation drill string. With the expression downhole tools it must be understood different tools for operations in a well, i.e. equipment for drilling operations, intervention equipment, equipment for logging, measuring, fishing, etc.

Wells carrying water, drilling fluid or hydrocarbons are hereafter denoted by the expression well.

The invention will represent a grinding function for a drill string that goes through a seal, while the drill string moves into or out of a well.

The invention will be particularly suited to operations that include pressure controlled drilling, as the invention appears as a risk reducing unit for any seal that seals against the moving drill string.

The methods used today to carry out well intervention or drilling in wells with the help of a drill string or coiled tubing are based on using a riser connection between the wellhead and the equipment on the drilling deck. Normally, one drills with a drilling fluid that has a higher specific density than what is expected of pressure from the formation, and normally the top of the riser will then be open with free access to the drilling fluid between the drill string and riser (annular space).

More and more reservoirs have challenges as a consequence of pressure loss or high pressure and high temperature. For the pressure loss wells, the possibility to be able to drill them will increase if the weight of the drilling fluid and thus the pressure on the formation can be reduced. For this to be carried out a seal must be arranged between the drill string and the riser to be able to tackle a possible pressure from the formation as a consequence of the safety margin being reduced due to the lighter drilling fluid. For reservoirs with a high pressure and high temperature it is desirable to be able to maintain the pressure in the formation during drilling. One can achieve this by sealing between the drill string and riser and thereafter pressurising the riser until the pressure at the end of the drill string is equal to the surrounding pressure from the formation. Then, one can drill with a reduced risk of damage to the formation.

Today there are several systems for dynamic sealing between the drill string and the riser. A common challenge for all seals is that they are exposed to wear and damage from sharp edges on the drill string. These sharp edges can typically arise from the jaws of the pliers that screw the pipes together and disconnect the screwed connection between the lengths of drill pipes. Even with special jaws on the pliers, very sharp edges arise on the outside of the drill string connection.

The seals are, as a rule, made from an elastomeric material that both seals on the thin part and the thicker part (the pipe coupling) of the drill string. When the thick part passes through the seal, the elastomeric seal will experience a strong tension and a sharp edge which will then goes through the seal will be able to generate open tears and ruptures in the seal.

The present invention has as an object to reduce the risk when drilling with what is called controlled pressure drilling, which includes one or more seals that seal around a dynamic drill string. The seal(s) represents one of the well barriers during operation and is thus a critical element. By removing sharp edges from the drill string the risk of damaging said seals is reduced, as well as the life time of the seal being extended.

The grinding arrangement has several configurations and these will be adapted to the outer diameter of the string that shall pass through the grinder.

From prior art, reference is made to U.S. Pat. No. 2,682,068 A—Harrigan, which relates to a grinding unit which is arranged to clean or grind the outer surface of a drill string. The grinding unit is used on pipe strings as they are pulled out of a borehole and then preferably for land-based boreholes. U.S. Pat. No. 2,307,449 A—Carpmail shows another example of a device to clean or grind a pipe string. NO 327281 B1—Siem WIS relates to a sealing arrangement for dynamic sealing around a drill string in an oil well and/or a gas well.

The present grinding arrangement to grind a drill string in wells carrying water, drilling fluid or hydrocarbons comprises a grinding arrangement that can be mounted together with other equipment and adjoining systems that are necessary to be able to carry out the operation in the well, whether it is an ocean bed-based well or a surface well, where the grinding arrangement can be a unit that can be brought along for well intervention with the help of a drill string. Furthermore, lubrication or a fluid under pressure can be injected into the grinder to cool between the grinder and drill string and also to remove possible residues after the grinding.

With the present invention the drill string can move into, or out of, the well independently of the well pressure. The grinding arrangement is preferably controlled, monitored and connected to a suitable control system.

A preferred embodiment of the grinding arrangement according to the invention is characterised by the characteristic part of the independent claim 1, in that a receiving unit is arranged to receive a grinding unit equipped with at least one grinding element, with the grinding element arranged to be driven into the receiving unit with the help of the drill string or an appropriate running tool and to be locked into the receiving unit, and that the receiving unit is placed in a riser, landing string or other connections between the drill deck and a wellhead, and over a sealing arrangement that is used during controlled pressure drilling for dynamic sealing of the drill string.

Alternative embodiments are given in the dependent claim.

The receiving unit can comprise at least one inlet channel for injection of a fluid to cool, lubricate and wash away grinding residues. Furthermore, the inlet channel can run through the grinding unit and end up at an area where the grinding unit abuts the drill string.

The grinding unit can be permanently fixed in the receiving unit, whereby grinding of the pipe coupling is arranged to be carried out by rotating the drill string. Correspondingly, grinding of the pipe coupling can be carried out by an axial movement of the drill string. Alternatively, the grinding unit can be mounted to rotate in the receiving unit, whereby the grinding of the pipe coupling is arranged to be carried out without rotation of the drill string.

The grinding elements of the grinding unit can be arranged to be driven into a grinding position that corresponds to the desired ground diameter of the pipe coupling. The grinding unit can also be arranged to be driven out of said grinding position.

In one embodiment the grinding unit can be arranged to take up angle deflections of the drill string, and can also function as a centraliser and movement dampener for the drill string.

The grinding unit can be locked securely into the receiving unit with the help of a number of locking devices. Furthermore, the grinding unit can be placed in sections in the receiving unit and arranged to be mounted around the drill string.

The receiving unit can be in an area below the grinding unit adapted to receive a number of seal sets placed after each other, where each seal is arranged to be locked in position with the help of respective locking devices, and arranged mutually spaced apart along the receiving unit.

The grinding unit can comprise one or more blocks with built-in grinding particles. Said block can be manufactured from rubber or polyurethane.

In connection with use of the grinding unit, this must always be placed above the relevant seal(s) in the construction.

Furthermore, the fluid injected into the grinder prevents the possibility of blockage of material that would reduce the effect of the grinder.

In connection with drilling operations in wells with the help of a drill string, the necessary complimentary systems will be used to maintain other functions that are required to carry out the operation (cutting and sealing functions, disconnecting systems, drilling fluid systems etc.). The power supply to the drill string (snubbing) will be taken care of by other systems when needed. This invention incorporates the grinding function and method only, with its unique, associated systems.

The invention does not take into account how the tool and the string which shall enter the well are operated or driven, and in this way covers any form of such methods.

The invention shall now be described in more detail with reference to the enclosed drawings in which:

FIG. 1 shows use of the grinding arrangement according to the invention with a drill string which passes through.

The present invention can be combined with a dynamic sealing arrangement as described in PCT/N008/00125 (corresponding to NO326492), said document is hereby incorporated by reference. Described in said document is a sealing arrangement for dynamic sealing around a drill string or coiled tubing, comprising an extended sealing unit which is arranged to surround the drill string, where the sealing unit comprises a number of sets of main seals arranged mutually spaced apart in the longitudinal direction in the sealing unit. Said main seals comprise, at least, one disc-formed or ring-formed packing element of an elastic material, such as an elastomeric material, arranged to surround said drill string. The main seal comprises at least one inlet channel arranged to receive a friction reducing medium through said seal, directly into the sealing surface of the packing element against the drill string.

Similarly, the present invention can be combined with a sealing arrangement as described in PCT/NO08/00274 (corresponding to NO327281), said documents are hereby incorporated by reference.

PCT/NO08/00274 relates to a sealing arrangement for dynamic sealing around a drill string in wells carrying water, drilling fluid or hydrocarbons, comprising at least one dynamic seal 35*a* which is arranged to surround the drill string 50 and a receiving unit 30 arranged to receive the, at least, one seal 35*a*, with the dynamic seal being arranged to be driven into the receiving unit 30 with the help of the drill string, and to be locked into the receiving unit. Internal pressure support can be provided in the sealing arrangement at least corresponding to the surrounding pressure. Said receiving unit 30 can be placed in an area on, or adjacent to, the drill deck of a drilling rig or vessel and in a riser, landing string or other connections between the drill deck and a well. Furthermore, the receiving unit is arranged to close the return side of the drilling fluid between the drill string and the upper part of the riser in that the receiving unit 30 is adjusted to receive a number of sealing sets placed after each other, where each seal is arranged to be locked in place with the help of respective locking devices 34*a*, 34*b*, 34*c* arranged mutually spaced apart along the length of the receiving unit. Furthermore, the receiving unit 30 can be, in connection with a floating rig or drilling ship, placed below the compensating unit for the riser, or that the receiving unit 30 in connection with a permanent installation is arranged to be a part of the riser connection.

Figure 1:
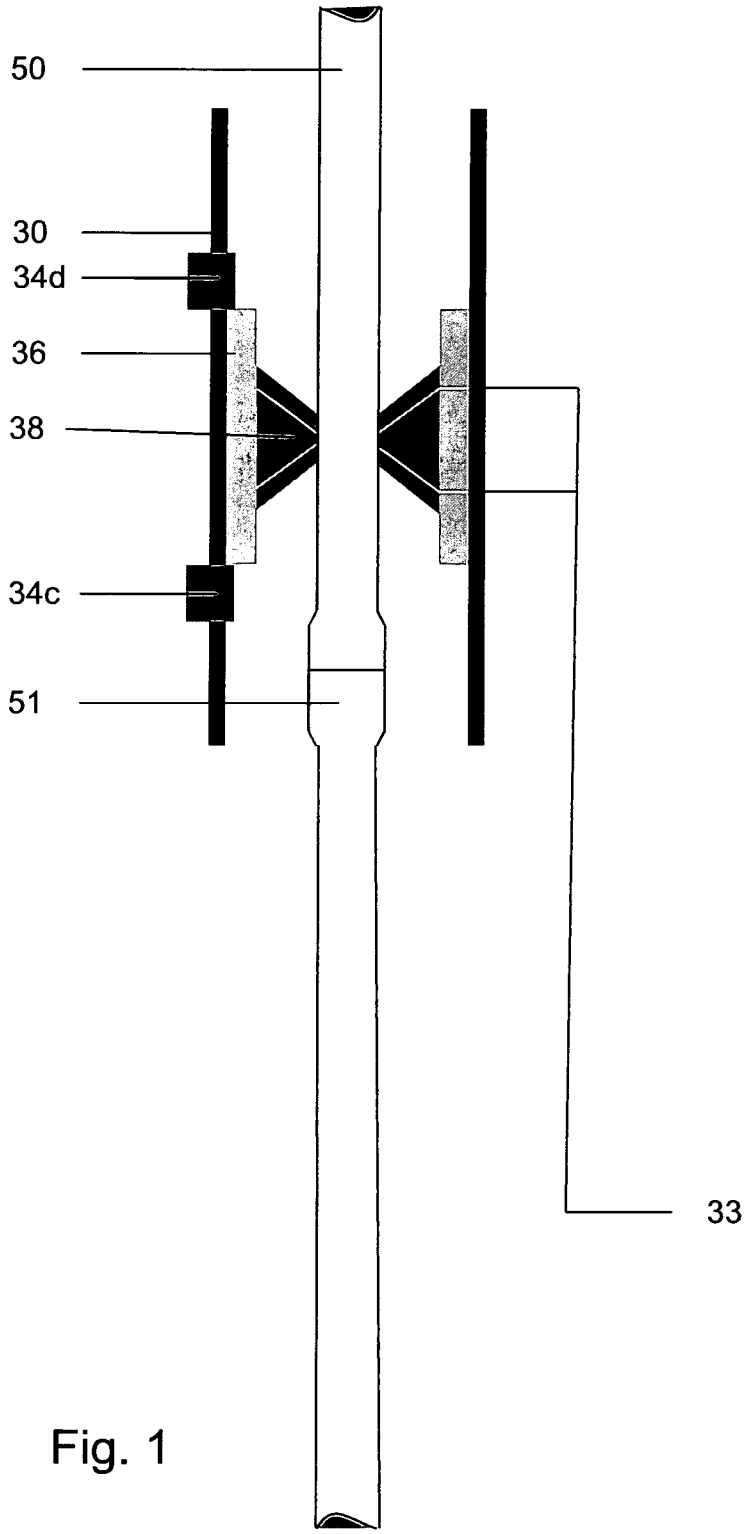

FIG. 1 show an application of the present grinding unit 36 placed in a housing or receiving unit 30. The grinding unit 36 and/or the receiving unit 30 can be placed and be pulled with the drill string or with a dedicated running tool or string. The grinding unit 36 is preferably locked in place in the receiving unit 30 by the locks 34*c* and 34*d*.

The coupling on drill string 51 normally has a larger diameter than the string 50 itself and when the drill string is moved through the grinding unit 36 the outer surface of the pipe coupling 51 is machined so that the irregularities that form the sharp edges on the pipe coupling are removed. These irregularities often arise as a consequence of marks from the jaws of pliers and machines used to connect the couplings 51 on the drill deck, but can also arise due to other kinds of treatment.

An injection line 33 can also be arranged to make it possible to inject a fluid for cooling, lubricating and cleaning of the grinding surface. The grinding unit 36 is here shown as a free standing unit, although mounted above seals (not shown).

Figure 2:
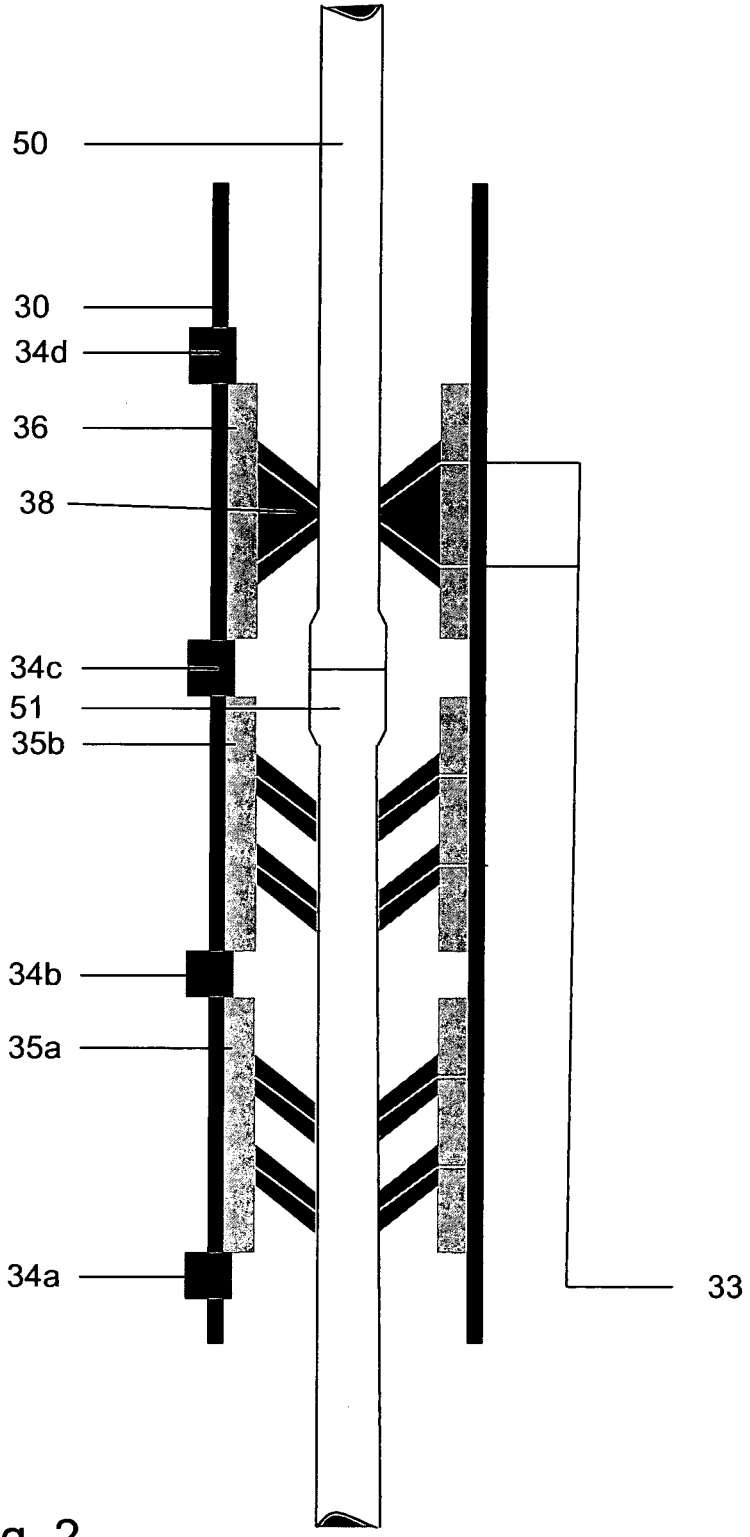
FIG. 2 shows use of the grinding arrangement according to the invention placed above the seals that seal against the drill string.

FIG. 2 shows an application of the present grinding unit 36 placed above the seals for the drill string 34*a* and 34*b*, and can thus constitute an integrated part. The grinding unit 36 and the seals 35*a* and 35*b* can be mounted in a common housing or receiving unit 30.

The principle for both the figures is that possible sharp edges on the pipe coupling 51 will be ground away when the drill pipe 50 is driven through the grinding unit 36. If the drill string 50 is rotated in addition while it passes through the grinding unit 36, one will get a considerable grinding effect, which can more or less polish the surface of the pipe coupling 51. This will also be achieved with an axial movement only of the drill string, for example, when an independent, rotary drill crown is mounted onto the drill string.

A typical embodiment of the grinding element or grinding block 38 in the grinding unit can be grinding particles in-built into an adapted block made from polyurethane or rubber. These can thereafter be placed to overlap in the circumference of the drill string or without any overlap. In the embodiment shown in the figures the block 38 is formed with a partial pointed contact surface against the drill string 50. The block can also be formed with a flat contact surface. This is applicable to the other grinding solutions. Furthermore, several blocks or grinding elements can be used, arranged next to each other in the receiving unit 30. The grinding unit 36 can be permanently mounted or rotary mounted in the receiving unit 30 and it can also be divided into parts so that it can be mounted around the drill string without the drill string having to be broken.

It will be an advantage to use grinding particles and solutions that are approved for cold processing, i.e. that they do not create sparks themselves when operating in air. However, any applicable grinding element may be used.

Other possible solutions are grinding discs, grinding files, grinding heads, etc., which can, in a corresponding way, be built into a block, or which can, in any other way, be set in the grinding unit 36 to provide the described grinding function.

The grinding arrangement can be localised on a drill deck, in a riser or straight onto a BOP and also subsea without a riser.

The grinding arrangement can be used on all wells carrying water, gas or hydrocarbons, and also drilling fluid, and can be used both in dry conditions or submersed in a liquid. Furthermore, it can function as a centraliser and movement dampener for the drill string.

Embodiment examples have been described here, but it must be understood that other configurations are possible within the framework of the invention.

The invention claimed is:

1. A system comprising:

a grinding unit to remove sharp edges on a pipe coupling of a drill string as a consequence of marks from jaws of pliers and machines used to connect the pipe couplings on a drill deck, and a receiving unit for receipt of the grinding unit, said grinding unit being equipped with at least one grinding element for grinding of the pipe coupling of the drill string in the receiving unit, as the grinding unit is arranged to be driven into the receiving unit with the help of the drill string or a suitable running tool and to be locked into the receiving unit, wherein the receiving unit is arranged in a riser, landing string or in other connections between the drill deck and a wellhead, and above a sealing arrangement used during pressure controlled drilling for dynamic sealing around the drill string.

2. The system according to claim 1, wherein the receiving unit comprises at least one inlet channel for injection of a fluid to cool, lubricate and wash away grinding residues.

3. The system according to claim 2, wherein the inlet channel runs through the grinding unit and ends up in an area where the grinding unit abuts the drill string.

4. The system according to claim 1, wherein the grinding unit is secure mounted in the receiving unit, whereby the grinding of the pipe coupling is arranged to be carried out by a rotation of the drill string.

5. The system according to claim 1, wherein the grinding unit is secure mounted in the receiving unit, whereby grinding of the pipe coupling is arranged to be carried out by an axial movement of the drill string.

6. The system according to claim 1, wherein the grinding unit is rotary mounted in the receiving unit, whereby the grinding of the pipe coupling is arranged to be carried out without rotation of the drill string.

7. The system according to claim 1, characterised in that wherein the grinding elements of the grinding unit are arranged to be driven into a grinding position, which corresponds to a wanted post-grinding diameter of the pipe coupling.

8. The system according to claim 7, wherein the grinding unit is adapted to be driven out of said grinding position.

9. The system according to claim 1, wherein the grinding unit is adapted to take up angle deflections of the drill string.

10. The system according to claim 1, wherein the grinding unit is locked secure into the receiving unit with the help of a number of locking devices.

11. The system according to claim 1, wherein the grinding unit is arranged in sections in the receiving unit and is arranged to be mounted around the drill string.

12. The system according to claim 1, wherein the receiving unit in an area below the grinding unit, is adapted to receive a number of sealing sets placed next to each other, where each seal is arranged to be locked secure with the help of respective locking devices arranged mutually spaced apart in the longitudinal direction of the receiving unit.

13. The system according to claim 1, wherein the grinding element comprises one or more grinding blocks with built-in grinding particles.

14. The system according to claim 13, wherein said block is manufactured from rubber or polyurethane.

* * * * *